US008177347B2

(12) United States Patent
Brewington et al.

(10) Patent No.: US 8,177,347 B2
(45) Date of Patent: May 15, 2012

(54) DUAL MODE PRINTER

(75) Inventors: Grace T. Brewington, Fairport, NY (US); Anthony S. Condello, Webster, NY (US); Daniel Martin Bray, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 390 days.

(21) Appl. No.: 12/504,227

(22) Filed: Jul. 16, 2009

(65) Prior Publication Data

US 2011/0012969 A1 Jan. 20, 2011

(51) Int. Cl.
*B41J 2/01* (2006.01)
*B41J 29/38* (2006.01)

(52) U.S. Cl. ..... 347/101; 347/102; 347/16

(58) Field of Classification Search ..... 347/104, 347/101, 16, 2
See application file for complete search history.

(56) References Cited

U.S. PATENT DOCUMENTS

| | | | | |
|---|---|---|---|---|
| 4,734,359 | A * | 3/1988 | Oguchi et al. | 346/135.1 |
| 5,364,829 | A * | 11/1994 | Kishimoto et al. | 503/201 |
| 5,543,381 | A * | 8/1996 | Kishimoto et al. | 503/201 |
| 5,545,381 | A * | 8/1996 | Iida et al. | 422/186 |
| 6,527,384 | B2 * | 3/2003 | Isago | 347/100 |
| 6,544,601 | B1 * | 4/2003 | Kong | 428/195.1 |
| 6,891,640 | B2 * | 5/2005 | Kakikawa et al. | 358/1.9 |
| 7,422,996 | B2 * | 9/2008 | Shimbo et al. | 503/201 |
| 2002/0072472 | A1 * | 6/2002 | Furuya et al. | 503/201 |
| 2005/0141906 | A1 * | 6/2005 | Murakami | 399/45 |
| 2005/0244742 | A1 * | 11/2005 | Iftime et al. | 430/270.1 |
| 2005/0244743 | A1 * | 11/2005 | Iftime et al. | 430/270.1 |
| 2005/0244744 | A1 * | 11/2005 | Kazmaier et al. | 430/270.1 |
| 2008/0191136 | A1 * | 8/2008 | Shrader et al. | 250/316.1 |
| 2008/0310869 | A1 * | 12/2008 | Iftime et al. | 399/51 |
| 2008/0317487 | A1 * | 12/2008 | Murakami | 399/45 |
| 2010/0227760 | A1 * | 9/2010 | Morimitsu et al. | 503/201 |

FOREIGN PATENT DOCUMENTS

| | | |
|---|---|---|
| EP | 0542192 | 5/1993 |
| EP | 2228221 | 9/2010 |
| JP | 2001334649 | 12/2001 |
| JP | 2001334649 A * | 12/2001 |

OTHER PUBLICATIONS

Machine Translation for Matsuura et al (JP Pat 2001334649); Published Dec. 4, 2001.*

European Patent Office, European Search Report, European Application No. 10169154.1, May 2, 2011, 3 pages.

* cited by examiner

*Primary Examiner* — Stephen Meier
*Assistant Examiner* — Leonard S Liang
(74) *Attorney, Agent, or Firm* — MH2 Technology Law Group LLP

(57) ABSTRACT

A dual mode imaging device includes an input for supplying a medium to the imaging device, the medium comprising at least one of an erasable paper, and a non-erasable paper. The erasable paper can be one of an imaged or a non-imaged erasable paper. A conventional imaging subsystem is provided for imaging the non-erasable paper. A heating subsystem is provided for heating an input medium to one of an erasing temperature, an imaging temperature, or a fusing temperature according to a type of job requirement. A cooling station selectively cools an erased medium to an imaging temperature. A write subsystem is provided for UV imaging an erased medium.

29 Claims, 6 Drawing Sheets

DUAL MODE PRINTER

DESCRIPTION OF THE INVENTION

1. Field of the Invention

This invention relates generally to imaging and, more particularly, to imaging both reversible write erasable paper and non-erasable paper in an imaging system.

2. Background of the Invention

Paper documents are often promptly discarded after being read. Although paper is relatively inexpensive, the quantity of discarded paper documents is enormous and the disposal of these discarded paper documents raises significant cost and environmental issues. In addition, it would be desirable that paper documents can be reusable, to minimize cost and environmental issues.

Photochromic paper, also known as erasable paper, provides an imaging medium that can be reused many times to transiently store images and documents. For example, photochromic paper employs photochromic materials to provide an imaging medium for containing desired images. Typically, photochromic materials can undergo reversible or irreversible photoinduced color changes in the photochromic containing imaging layer. In addition, the reversible photoinduced color changes enable image-writing and image-erasure of photochromic paper in sequence on the same paper. For example, an ultraviolet (UV) light source can be used for inducing image-writing, while a combination of heat and a visible light source can be used for inducing image-erasure. An inkless erasable imaging formulation is the subject of U.S. patent application Ser. No. 12/206,136 filed Sep. 8, 2008 and titled "Inkless Reimageable Printing Paper and Method" which is commonly assigned with the present application to Xerox Corp., and is incorporated in its entirety herein by reference.

Because imaging of erasable paper has unique requirements, it has previously required dedicated equipment. In particular, a UV source is typically required to image the erasable paper, and heat is required to erase an imaged erasable paper. In addition, specific temperature parameters are required for erasing erasable paper and for heating the erasable paper to a temperature suitable for UV imaging. Known imaging devices cannot support the specific requirements for imaging erasable paper, and separate equipment must therefore be purchased to accommodate each type of printing.

Thus, there is a need to overcome these and other problems of the prior art and to provide a dual mode imaging device in which both erasable paper and non-erasable paper can be selectively imaged. Even further, the dual mode imaging device should be capable of interchangeably sharing imaging components.

SUMMARY OF THE INVENTION

According to various embodiments, the present teachings include a dual mode imaging system. This system includes an input for supplying a medium to the imaging device, the medium comprising at least one of an imaged erasable paper, a non-imaged erasable paper, and a non-erasable medium; an imaging subsystem for imaging the non-erasable medium; a heating subsystem for selectively heating an input medium to one of an erasing temperature, an imaging temperature, and a bonding temperature according to a type of job specified; a cooling subsystem for selectively cooling an erased medium to an imaging temperature; and a write subsystem for imaging erasable paper medium.

According to various embodiments, the present teachings also include a method for dual mode imaging. This method includes supplying a medium to a dual mode imaging device, the medium comprising at least one of an imaged erasable paper, a non-imaged erasable paper, and a non-erasable medium; imaging the non-erasable medium in an imaging subsystem; heating an input medium to one of an erasing temperature, an imaging temperature, and a fusing (transfusing) temperature according to a type of supplied medium in a heating subsystem; selectively cooling an erased medium to an imaging temperature at a cooling station; and imaging an erasable paper at a write subsystem.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and together with the description, serve to explain the principles of the invention.

Figure 1:
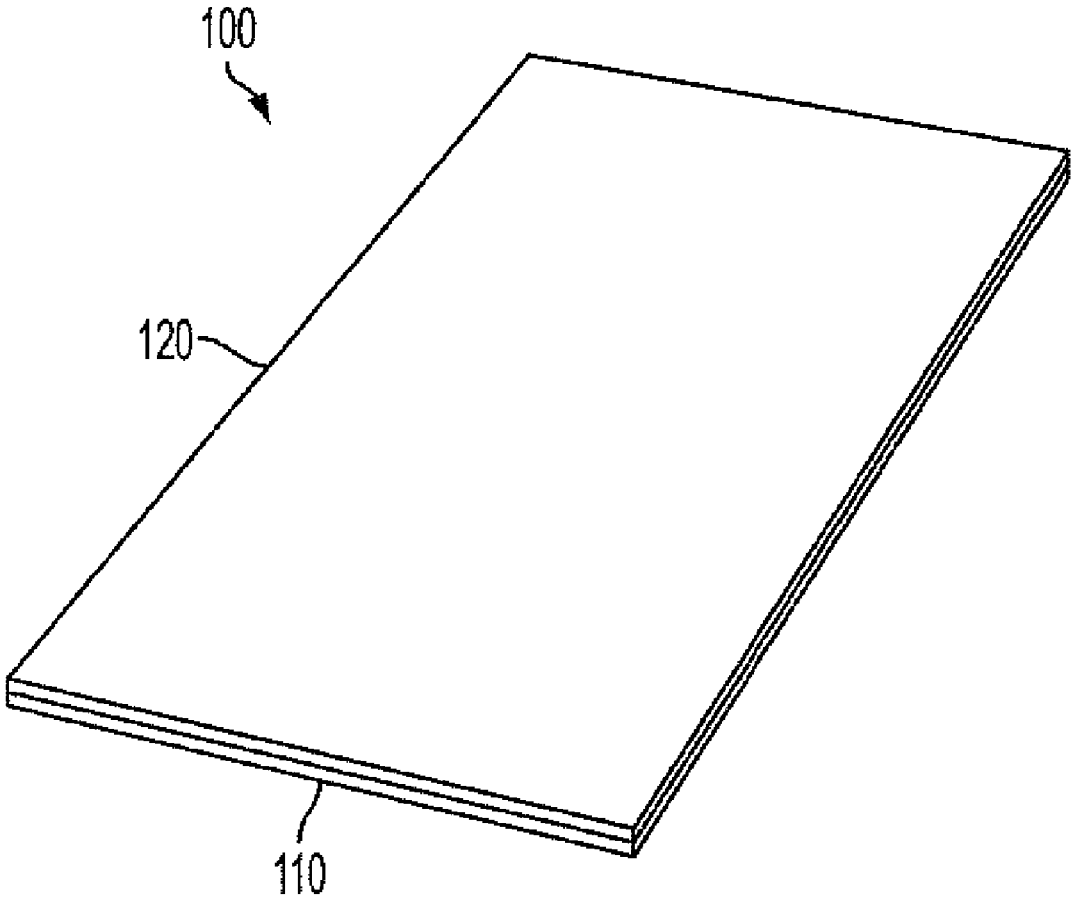
FIG. 1 is a perspective depiction of a transient document page having a photochromic coating which allows for writing an image in the coating on the page and for erasing an image from the coating.

It should be noted that some details of the figures have been simplified and are drawn to facilitate understanding of the inventive embodiments rather than to maintain strict structural accuracy, detail, and scale.

DESCRIPTION OF THE EMBODIMENTS

Reference will now be made in detail to the present embodiments (exemplary embodiments) of the invention, examples of which are illustrated in the accompanying drawings. Wherever possible, the same reference numbers will be used throughout the drawings to refer to the same or like parts. In the following description, reference is made to the accompanying drawings that form a part thereof, and in which is shown by way of illustration specific exemplary embodiments in which the invention may be practiced. These embodiments are described in sufficient detail to enable those skilled in the art to practice the invention and it is to be understood that other embodiments may be utilized and that changes may be made without departing from the scope of the invention. The following description is, therefore, merely exemplary.

While the invention has been illustrated with respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." The term "at least one of" is used to mean one or more of the listed items can be selected.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume values as defined earlier plus negative values, e.g. −1, −1.2, −1.89, −2, −2.5, −3, −10, −20, −30, etc.

As used herein, the term "erasable paper" refers to a transient document that has the appearance and feel of traditional paper, including cardstock and other weights of paper. Erasable paper can be selectively imaged and erased.

As used herein, an imaged erasable paper refers to an erasable paper having a visible image thereon, the image a result of, for example, ultraviolet (UV) imaging the erasable paper. A non-imaged erasable paper refers to an erasable paper in the original or erasable paper having an image erased therefrom and available for UV imaging. An exemplary erasable paper is described in connection with FIG. 1 below.

As used herein, the term "non-erasable" refers to a traditional medium of the type used in any conventional imaging such as ink jet, xerography, or liquid ink electrophotography, as known in the art. An example of a traditional medium can be paper.

As used herein, the term "medium" can include paper or similar medium suitable for one or more of erasable paper imaging or conventional imaging.

FIG. 1 depicts an exemplary erasable paper 100 in accordance with the present teachings. It should be readily apparent to one of ordinary skill in the art that the erasable paper 100 depicted in FIG. 1 represents a generalized schematic illustration and that other layers can be added or existing layers can be removed or modified.

As shown in FIG. 1, the erasable paper 100 can include a substrate 110 and a photochromic material 120 incorporated into or onto the substrate 110. The photochromic material 120 can provide a reversible writing erasable image-forming component on the substrate 110.

The substrate 110 can include, for example, any suitable material such as paper, wood, plastics, fabrics, textile products, polymeric films, inorganic substrates such as metals, and the like. The paper can include, for example, plain papers such as XEROX® 4024 papers, ruled notebook paper, bond paper, and silica coated papers such as Sharp Company silica coated paper, Jujo paper, and the like. The substrate 110, such as a sheet of paper, can have a blank appearance.

In various embodiments, the substrate 110 can be made of a flexible material and can be transparent or opaque. The substrate 110 can be a single layer or multi-layer where each layer is the same or different material and can have a thickness, for example, ranging from about 0.05 mm to about 5 mm.

The photochromic material 120 can be impregnated, embedded or coated to the substrate 110, for example, a porous substrate such as paper. In various embodiments, the photochromic material 120 can be applied uniformly to the substrate 110 and/or fused or otherwise permanently affixed thereto.

Portion(s) of photochromic material of an imaged erasable paper 100 can be erased. In order to effect the transition from a visible image to an erased document, heat can be applied to the transient document 100 at a temperature suitable for effecting the erasure. For example, at a temperature of about 160° C., the erasable paper 100 can be completely erased. In order to re-image the erased (or image an original) erasable paper 100, the erasable paper 100 can be heated to a temperature of about 65° C. before writing, for example, using UV exposure.

It will be appreciated that other types of erasable paper, other than photochromic paper, can be used in connection with the exemplary embodiments herein. Such types of erasable paper are intended to be included within the scope of the disclosure.

While the temperatures for processing erasable paper can be achieved and maintained in a single mode device for imaging and erasing erasable paper, the following describes an exemplary incorporation of a dual mode printing system capable of processing erasable paper as well as producing traditional (non-erasable) prints and copies. The regular prints and copies can be produced by ink jet, xerography, and liquid ink electrophotography. The ink jet can include aqueous ink jet, solid ink jet and gel ink jet. By a unique hardware reduction as described in the following, existing fuse or transfuse subsystems of conventional imaging devices can be used to erase erasable paper at a suitable erase temperature and to heat erasable paper to a temperature suitable for imaging, for example UV imaging, of the photochromic medium.

Figure 2:
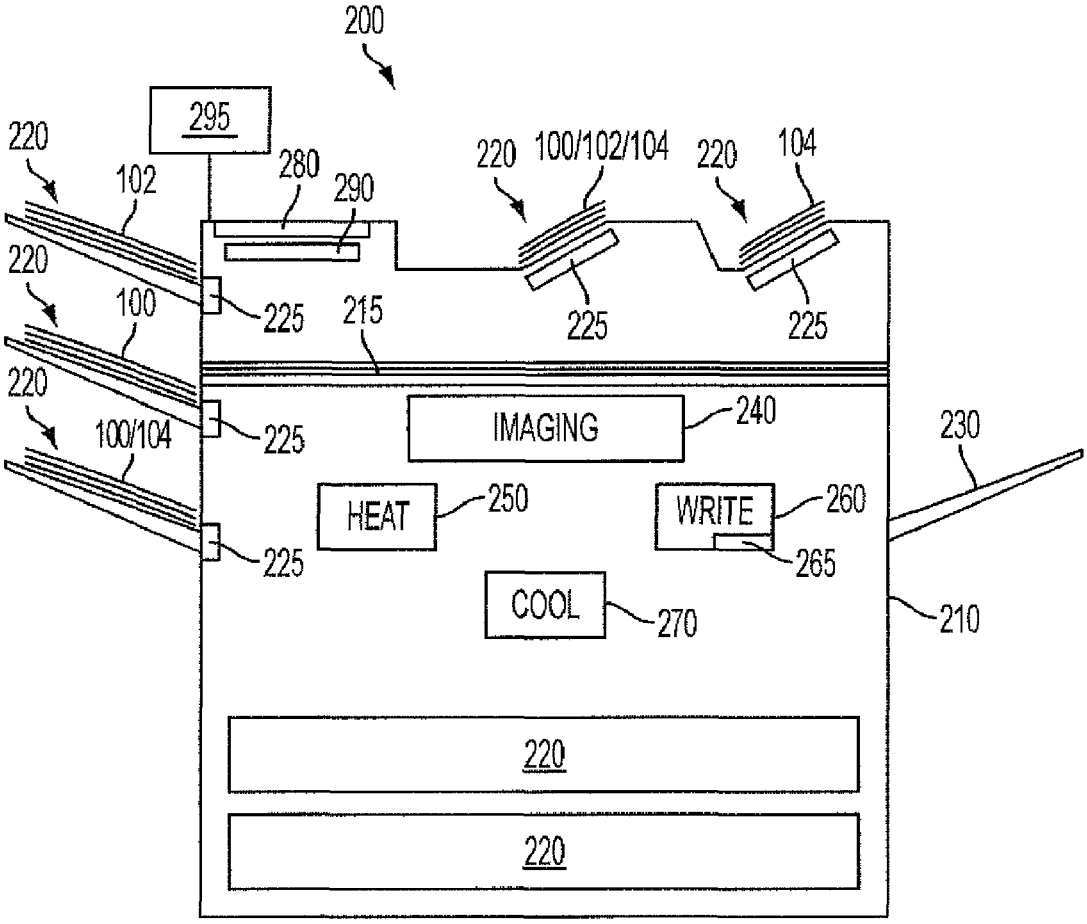
FIG. 2 depicts a dual mode imaging apparatus in accordance with the present teachings.

FIG. 2 depicts an exemplary dual mode imaging system 200 in accordance with the present teachings. It should be readily apparent to one of ordinary skill in the art that the dual mode imaging system 200 depicted in FIG. 2 represents a generalized schematic illustration and that other components can be added or existing components can be removed or modified.

As shown in FIG. 2, the dual mode imaging system 200 can include a housing 210 with document input 220 and document output 230 locations. In addition, the dual mode imaging system 200 can include a platen 215, an imaging subsystem 240, a heating subsystem 250, a write subsystem 260, a cooling subsystem 270, a user interface 280, a control system 290, and an administrator interface 295.

The housing 210 can be of a material and size to accommodate the exemplary components of the dual mode imaging system 200. In certain embodiments, the housing 210 can include a desktop device. The housing 210 can further include a full size floor supported device. Sizes for each are known in the art and not intended to limit the scope of the invention.

The document inputs 220 can include one or more input trays for each of an erasable paper 100, non-erasable paper 104, and mixed erasable and non-erasable 100/104. As used herein, if an erasable paper is in the original state, i.e. not previously imaged, it can also be referred to as an "erased" erasable paper for ease of description. For the erasable paper, separate input trays can be provided for each of erased 100 and imaged erasable 102 papers in order to distinguish an operation within the dual mode imaging system 200 relevant to each. Other combinations of documents are intended to be within the scope of the disclosure. Although the input trays are initially labeled by example and purposes of discussion according to the type of document therein; their relative arrangement both interior and exterior to the housing 210 can be altered according to a configuration of components within the housing 210.

In certain embodiments, a sensor 225 can be provided to detect a type of document entering the dual mode imaging device 200. The sensor 225 can be proximate each input tray 220, incorporated in the input tray 220, or interior of the housing 210. For example, the sensor 225 can detect an erasable paper 100 and control system 290 can direct that document to the heating subsystem 250 to heat the erasable paper 100 to a temperature suitable for imaging, and then to the write subsystem 260 for that imaging. Imaging can include UV imaging and the heating subsystem can heat the erased paper to a temperature suitable for UV imaging. Likewise, the sensor 225 can detect an erasable (e.g. imaged) erasable paper 102 and control system 290 directs that document to the heating subsystem 250 for erasure, the cooling subsystem 270 for cooling and then to the write subsystem 260 for imaging. In the event the sensor 225 detects a non-erasable document 104, the document can be directed to the toner imaging subsystem 240 for conventional imaging.

The imaging subsystem 240 can include components suitable for imaging a non-erasable paper 104. In certain embodiments, the imaging subsystem 240 can include any of an ink jet imaging system, a xerographic imaging system, and a liquid ink electrophotography imaging system. In certain embodiments, the imaging subsystem 240 can be incorporated with the heat subsystem 250, thereby reducing hardware of the dual mode imaging apparatus 200 as will be described in the following. It will be appreciated that the dual mode imaging device 200 can be a multifunction device (MFD) instead of a single function printer, incorporating erasable paper imaging or copying as well as non-erasable paper printing and copying, scanning and facsimile.

The heating subsystem 250 can include hardware capable of elevating a surface temperature of an erasable paper. Further, the heating subsystem 250 can include hardware capable of elevating a temperature of an erasable paper throughout the paper. In general, the heating subsystem 250 can operate to generate heat in a range of about 65° C. to about 160° C. At a temperature of about 160° C., the heating subsystem 250 can erase an imaged transient document 102. At a temperature of about 65° C., the heating subsystem 250 can heat an erased or original erasable paper 100 to a temperature suitable for UV imaging at the write subsystem 260.

In certain embodiments, the heating subsystem 250 can include heat rolls, heating lamps, flash lamps, heating pads, and temperature and power controls.

In certain embodiments, the write subsystem 260 can include imaging components suitable for imaging erasable paper. For example, the write subsystem 260 can UV image an erased or original erasable paper 100 once the erasable paper reaches a predetermined temperature. An exemplary UV imaging temperature of a transient document is about 65° C. Other UV, IR or similar imaging temperatures can be set according to a type of erasable paper and such imaging temperatures are intended to be included within the scope of the invention.

In a case where a write operation occurs directly following an erase operation, the erased erasable paper 102 can pass from the heating subsystem 250 to the cooling subsystem 270 prior to advancing to the write subsystem 260. In order to reach a temperature suitable for imaging, the erased and cooled transient document 100 can again pass through the heating subsystem 250 to attain the desired imaging temperature prior to feed of the erasable paper 100 to the write subsystem 260. For example, the erasable paper 100 can be heated to a UV imaging temperature of about 65° C. prior to entering the write subsystem 260. Likewise, the erasable paper 100 can be heated to a UV imaging temperature within the write subsystem 260 via an internal heater 265.

The cooling subsystem 270 can include active cooling of an erasable paper 100. The cooling subsystem 270 can include passive cooling of the erasable paper 100. In an active cooling, the cooling subsystem 270 can direct a flow of cooling medium, such as cold air, onto the erasable paper 100. Active cooling can take place for a period of time and temperature suitable to reduce a temperature of the erasable paper 100 to an ambient temperature. Ambient temperature can include a temperature below an imaging temperature. For example, ambient temperature can include room temperature. Further, active cooling can take place for a period of time and at a temperature suitable to reduce the temperature of the erasable paper 100 to a UV imaging temperature. In certain embodiments, active cooling of the cooling subsystem 270 can include a fan. In certain embodiments, active cooling of the erasable paper 100 at the cooling subsystem 270 can include cold plates, rollers, condensers, and similar cooling apparatus acting on or adjacent to the erasable paper.

The cooling subsystem 270 can further be incorporated in a cycle to cool an imaged erasable paper subsequent to imaging. In certain embodiments, the imaged erasable paper can therefore be cooled prior to discharge from the dual mode imaging device 200 into the output tray 230.

In certain embodiments, a user interface 280 can be provided in the housing 210. The user interface 280 can include control components, responsive to user input, for directing the functions of the dual mode imaging system 200. In certain embodiments, the dual mode imaging system 200 can be configured through the user interface 280 to start up in a single printing mode (erasable paper mode or regular printing mode for printing or copying non-erasable paper documents) or in dual printing mode. For cases where the dual mode imaging system 200 is started in a single printing mode, the dormant printing mode can remain in a sleep state.

In certain embodiments, an administrator interface 295 can be provided via network connection to the housing 210. The administrator interface 295 can include control options directing the functions of the dual mode imaging system. In certain embodiments, the dual mode imaging system 200 can be configured through the administrator interface 295 to start up in a single printing mode (transient document more or regular printing mode for printing or copying non-transient documents) or in dual printing mode. For cases where the dual mode imaging system 200 is started in a single printing mode, the dormant printing mode can remain in a sleep state.

In certain embodiments, the dual mode imaging system 200 can produce jobs that select only erasable paper, jobs that select only non-erasable paper, and/or jobs that select an erasable paper for at least one of the sheets and a non-erasable paper for at least one of the sheets. Job selection can be executed at the user interface 280. Alternatively, job selection can be executed at the administrator interface 295. In a third alternative, job selection can be executed at the user's personal computer print dialog box through the properties link to the print driver controls. For dual mode imaging where the operator will mix erasable paper and non-erasable paper within a job, at least two feed trays are preferred, with at least one tray for erasable paper and at least one tray for non-erasable paper. Alternatively, the user interface 280 can prompt the operator to check for the proper media at the job start and at the transition to the other printing mode. The user interface 280 can further be responsive to the sensor 225 and the sensor 225 can be responsive to input at the user interface 280.

The dual mode imaging system 200 can be alerted through the user interface 280 to initiate or transition between any of an erasable paper imaging state, a sleep state and a standby state. Alternatively, the dual mode imaging system 200 can be alerted through the administrator interface 295 or through control software to initiate or transition between any of a transient document imaging state, sleep state and a standby state. Transitioning to the standby state can require a predetermined amount of time according to whether or not the heat subsystem 250 is heated to an erase temperature for an erasable paper or to a temperature suitable for heating an erasable paper to an imaging temperature, such as for UV imaging. In a transient document imaging state, the dual mode imaging system 200 can be alerted through the user interface 280, or through the administrator interface 295 or through control software to transition conventional printing from the standby state to sleep state. This can save energy for configurations where the heating subsystem 250 operates to erase an erasable paper and where heating operates to heat the erasable paper to a temperature suitable for imaging in the write subsystem.

For erasable paper imaging, the dual mode imaging system can automatically transition from standby state to sleep state via a timing algorithm.

Figure 3:
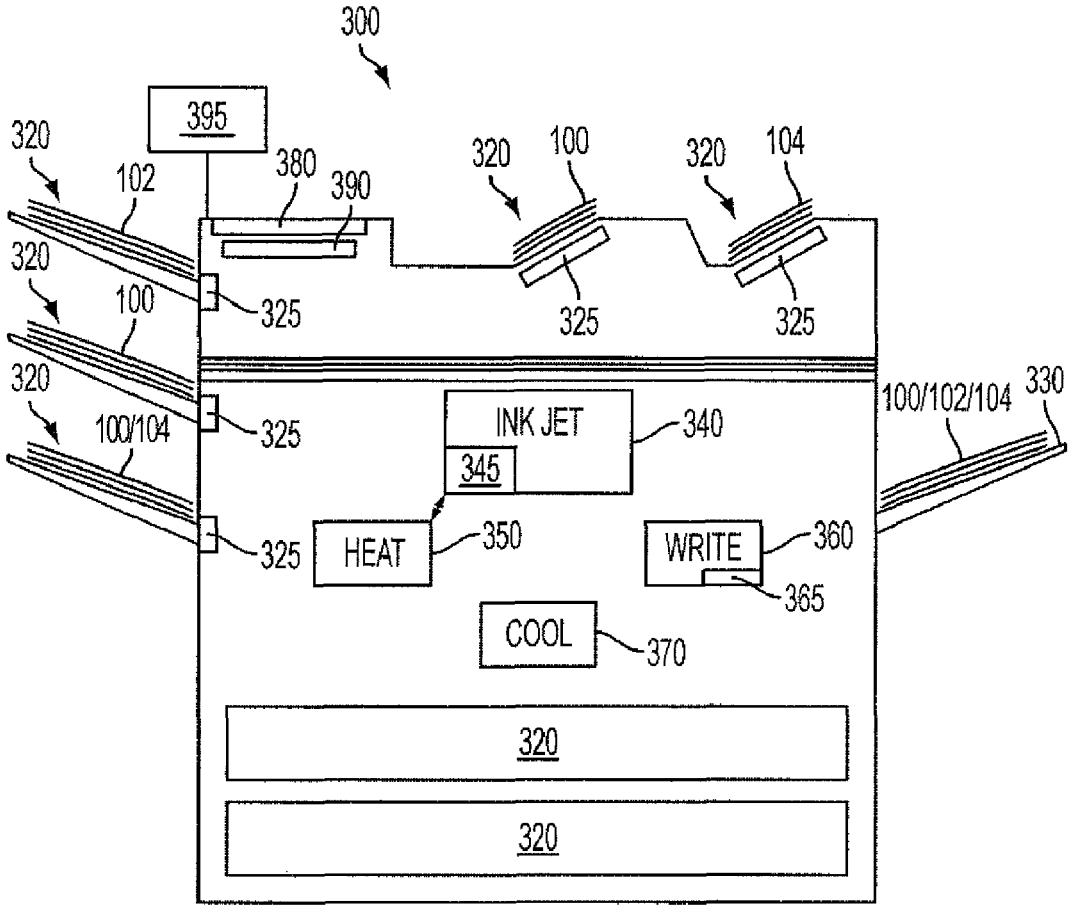
FIG. 3 is a schematic diagram depicting a dual mode imaging apparatus including both an ink jet imaging and erasable paper imaging in accordance with the present teachings.

FIG. 3 is a schematic illustration depicting a relationship of components in an exemplary dual mode imaging system 300 in accordance with the present teachings. In particular, FIG. 3 depicts a system combining erasable paper imaging and ink jet imaging. It should be readily apparent to one of ordinary skill in the art that the dual mode imaging system 300 depicted in FIG. 3 represents a generalized schematic illustration and that other components can be added or existing components can be removed or modified.

In certain embodiments, the dual mode imaging system 300 of FIG. 3 can include a heat subsystem 350 and a write subsystem 360 in addition to an ink jet subsystem 340.

When an erasable paper is used or selected for imaging, the erasable paper can bypass the ink jet subsystem 340. In certain embodiments, the erasable paper can pass through the ink jet subsystem 340, without activating the ink jet subsystem. In some erasable paper plus ink jet configurations, erasable paper can be passed through the heat subsystem 350 to erase the erasable paper, then cooled (actively or passively) at the cooling subsystem 370, then heated or maintained at a temperature suitable for imaging by the heating subsystem 350 during the imaging in the write subsystem 360. Imaging can be by UV imaging. Imaged erasable paper 100 can then bypass or pass through the standard ink jet subsystem 340 and be stacked on an output tray 330.

In certain embodiments, the dual mode imaging system 300 can include one or more feed trays 320. For the case where there is only one feed tray, an operator can keep track of the media loaded in the single feed tray and suitability for the print mode selected. For a dual mode imaging system with two or more feed trays 320, one tray can be designated for erasable paper and another feed tray can be designated for non-erasable paper.

In certain embodiments, for example with a solid ink jet as the ink jet subsystem, a transfuse subsystem 345 for solid ink jet may also function as the heating subsystem 340 of the dual mode imaging system 300. The heating subsystem 340 can therefore perform a transfusing function for the solid ink jet subsystem, an erase function for the erasable paper and a heating function to raise the temperature of the erasable paper to a temperature suitable for imaging. A heater 365 for raising the temperature to the erasable paper to a temperature suitable for imaging can also be positioned within the write subsystem 360. Utilizing the transfuse subsystem 345 of the solid ink jet subsystem 340 for each of the transfuse function, erase function, and heating for imaging can yield cost savings due to hardware reduction. In these configurations, erasable paper can pass through the transfuser 345 of standard solid ink jet subsystem 340 to erase the erasable paper, then cooled (actively or passively) at the cooling subsystem 370, and then heated to or maintained at a writing temperature to conduct the exposure write step. Imaged erasable paper can then be transported for stacking on the output tray 330.

In certain embodiments using erasable paper plus solid ink jet subsystems 340, and where only pre-erased or original erasable papers are loaded into the dual mode imaging device 300, the transfuse subsystem 345 for solid ink jet can also function as the heater for the writing step. This yields cost saving due to hardware reduction. In these configurations, erasable paper can pass through the transfuser 345 of standard solid ink jet subsystem 340 to heat the erasable paper to a temperature suitable for imaging in the write subsystem 360. Imaged erasable paper can then be transported for stacking on the output tray 330.

The dual mode imaging system 300 can further be alerted through the user interface 380 or through administrative interface 395 or through control software 390 to transition solid ink jet printing from a standby state to a sleep state. The dual mode imaging system 300 can save the greatest amount of energy in the sleep state relative to standby state. In certain embodiments, the dual mode imaging system can automatically transition solid ink jet printing from a standby state to a sleep state via a timing algorithm.

In certain embodiments, such as aqueous ink technology, no significant time is needed to transition from a sleep state to a standby because there are no components to warm up.

It will be appreciated that the dual mode imaging device 300 can be a multifunction device (MFD) instead of a single function printer, incorporating erasable paper imaging or copying as well as non-erasable paper printing and copying, scanning and facsimile.

Figure 4:
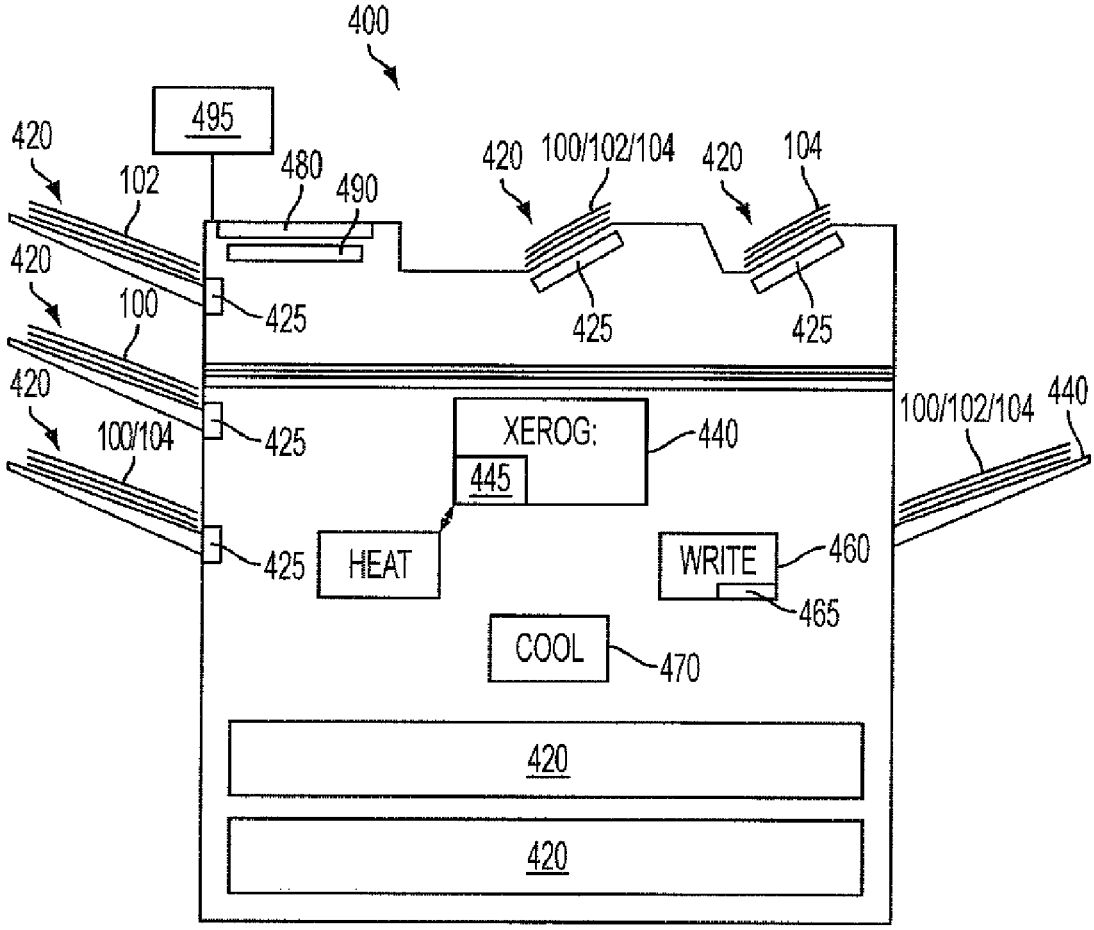
FIG. 4 is a schematic diagram depicting the dual mode imaging apparatus including both a xerography imaging subsystem and erasable paper imaging subsystem, in accordance with the present teachings.

FIG. 4 is a schematic illustration depicting a relationship of components in an exemplary dual mode imaging system 400 in accordance with the present teachings. In particular, FIG. 4 depicts a system combining erasable paper imaging and xerographic imaging. It should be readily apparent to one of ordinary skill in the art that the dual mode imaging system 400 represents a generalized schematic illustration and that other components can be added or existing components can be removed or modified.

In certain embodiments, the dual mode imaging system 400 of FIG. 4 can include a heat subsystem 450 and a write subsystem 460 in addition to a xerographic imaging subsystem 440.

When an erasable paper 100 is used or selected for imaging, the erasable paper can bypass the xerographic imaging subsystem 440. In certain embodiments, the erasable paper can pass through the xerographic imaging subsystem 440, without activating the xerographic imaging subsystem 440. In some erasable paper plus xerographic imaging configurations, erasable paper can be passed through the heat subsystem 450 to erase the erasable paper, then cooled (actively or passively) at the cooling subsystem 470, then heated or maintained at writing temperature by the heat subsystem 450 during the imaging in the write subsystem 460. Imaged erasable paper 102 can then bypass or pass through the standard xerographic imaging subsystem 440 and be stacked on an output tray 430. In certain embodiments, the write subsystem 460 can include a heater 465 for raising the temperature to the erasable paper to a temperature suitable for imaging, for example UV imaging.

In certain embodiments, the dual mode imaging system 400 can include one or more feed trays 420. For the case where there is only one feed tray 420, an operator can keep track of the media loaded in the single feed tray 420 and suitability for the print mode selected. For the dual mode imaging system 400 with two or more feed trays 420, one tray can be designated for erasable paper and another feed tray can be designated for non-erasable paper.

In certain embodiments, for example with the xerographic imaging subsystem 440, a fusing subsystem 445 for the xerographic imaging subsystem can also function as the heating subsystem 450 of the dual mode imaging system 400. The heating subsystem 450 can therefore perform a fusing function for the xerographic imaging subsystem 440, an erase function for the erasable paper, and a heating function to raise the temperature of the erasable paper to a temperature suitable for imaging. Utilizing the fusing subsystem 445 of the xerographic imaging subsystem 440 for each of the fusing function, erase function, and heating for imaging can yield cost savings due to hardware reduction. In these configurations, erasable paper can pass through the fusing device 445 of the xerographic imaging subsystem 440 to erase the erasable paper, then be cooled (actively or passively) at the cooling subsystem 470, and then be heated to or maintained at a writing temperature to conduct the exposure write step at the write subsystem 460. Imaged sheets can then be transported for stacking on the output tray 430.

In certain embodiments using erasable paper 100 plus the xerographic imaging subsystem 400, and where only pre-erased or original erasable paper 102 are loaded into the dual mode imaging device 400, the fusing device 445 of the xerographic imaging subsystem 440 can also function as the heater for the writing step. This yields cost saving due to hardware reduction. In these configurations, erasable paper can pass through the fuser 445 of the xerographic imaging subsystem 440 to heat the erasable paper 100 to a temperature suitable for imaging in the write subsystem 460. Imaged erasable paper can then be transported for stacking on the output tray 430.

In certain embodiments, the dual mode imaging system 400 can be alerted through a user interface 480 or through an administrator interface 495 or through control software 490 to transition a xerographic printing mode from a sleep state to a standby state. Transitioning to standby state can require some amount of time to warm up the fuser 445. Likewise, the dual mode imaging system 400 can be alerted through the user interface 480 or through the administrator interface 495 or through control software 490 to transition a xerographic printing mode from standby state to sleep state. This can save energy for configurations where the fuser uses energy in the standby state. In certain embodiments, the dual mode imaging system 400 can automatically transition xerographic printing from standby state to sleep state via a timing algorithm.

It will be appreciated that the dual mode imaging device 400 can be a multifunction device (MFD) instead of a single function printer, incorporating erasable paper imaging or copying as well as non-erasable paper printing and copying, scanning and facsimile.

Figure 5:
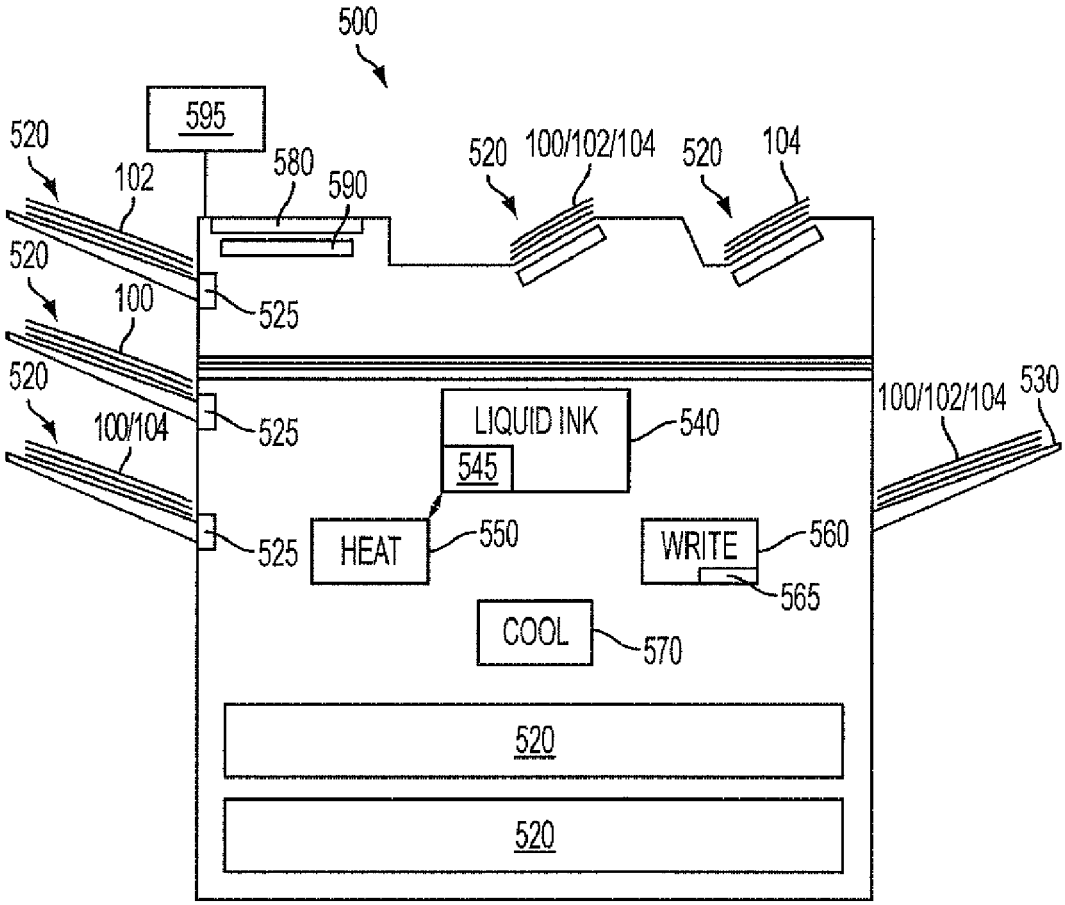
FIG. 5 is a schematic diagram depicting the dual mode imaging apparatus including both a liquid ink electrophotography imaging subsystem and erasable paper imaging subsystem, in accordance with the present teachings.

FIG. 5 is a schematic illustration depicting a relationship of components in an exemplary dual mode imaging system 500 in accordance with the present teachings. In particular, FIG. 5 depicts a system combining erasable paper imaging and liquid ink electrophotography. It should be readily apparent to one of ordinary skill in the art that the dual mode imaging system 500 represents a generalized schematic illustration and that other components can be added or existing components can be removed or modified.

In certain embodiments, the dual mode imaging system 500 of FIG. 5 can include a heat subsystem 550 and a write subsystem 560 in addition to a liquid ink electrophotography subsystem 540.

When an erasable paper 100 is used or selected for imaging, the erasable paper 100 can bypass the liquid ink electrophotography subsystem 440. In certain embodiments, the erasable paper 100 can pass through the liquid ink electrophotography subsystem 440, without activating the liquid ink electrophotography subsystem 440. In some erasable paper plus liquid ink electrophotography configurations, erasable paper 100 can pass through the heat subsystem 450 for raising the temperature to the erasable paper to a temperature suitable for imaging erasable paper, then be cooled (actively or passively) at the cooling subsystem 570, and then heated to or maintained at a writing temperature by the heat substation 550 during imaging in the write subsystem 560. Imaged erasable paper can then bypass or pass through the liquid ink electrophotography subsystem 560 and be stacked on an output tray 530. In certain embodiments, the write subsystem 560 can include a heater 565 for raising the temperature to the erasable paper to a temperature suitable for imaging, for example UV imaging.

In certain embodiments, the dual mode imaging system 500 can include one or more feed trays 520. For the case where there is only one feed tray 520, an operator can keep track of the media loaded in the single feed tray 520 and suitability for the print mode selected. For a dual mode imaging system with two or more feed trays 520, one tray can be designated for erasable paper 100 and another feed tray can be designated for non-erasable paper 104.

In certain embodiments, for example with the liquid ink electrophotography subsystem 540, a transfuser 545 for the liquid ink electrophotography subsystem 540 can also function as the heating subsystem of the dual mode imaging system 500. The heating subsystem 550 can therefore perform a transfusing function for the liquid ink electrophotography subsystem 540, an erase function for the erasable paper 100 and a heating function to raise the temperature of the erasable paper 100 to a temperature suitable for imaging. Utilizing the transfuser 545 of the liquid ink electrophotography subsystem 540 for each of the transfusing function, erase function, and heating for imaging can yield cost savings due to hardware reduction. In these configurations, erasable paper can pass through the transfuser 545 of the liquid ink electrophotography subsystem 540 to erase the erasable paper, then cooled (actively or passively) at the cooling subsystem 570, and then heated or maintained at writing temperature to conduct the exposure write step at the write subsystem 560. Imaged sheets can then be transported for stacking on an output tray 530.

In certain embodiments using erasable paper 100 plus the liquid ink electrophotography subsystem 540, and where only pre-erased erasable paper is loaded into the dual mode imaging device 500, the transfuser 545 device of the liquid ink electrophotography subsystem 540 can also function as the heater for the writing step. This yields cost saving due to hardware reduction. In these configurations, erasable paper can pass through the transfuser 545 of the liquid ink electrophotography subsystem 540 to heat the erasable paper to a temperature suitable for imaging in the write subsystem 560. Imaged erasable paper can then be transported for stacking on the output tray 530.

In certain embodiments, the dual mode imaging system 500 can be alerted through a user interface 580 or through administrator interface 595 or through control software 590 to transition a liquid ink electrophotography printing mode from a sleep state to a standby state. Transitioning to standby state can require some amount of time to warm up the transfuser 545. Likewise, the dual mode imaging system 500 can be alerted through the user interface 580 or through the administrator interface 595 or through control software to transition a liquid ink electrophotography printing mode from standby stat to sleep state. This can save energy for configurations where the transfuser uses energy in the standby state. In certain embodiments, the dual mode imaging system 500 can automatically transition liquid ink electrophotography printing from standby state to sleep state via a timing algorithm.

It will be appreciated that the dual mode imaging device 500 can be a multifunction device (MFD) instead of a single function printer, incorporating erasable paper imaging or copying as well as non-erasable paper printing and copying, scanning and facsimile.

Figure 6:
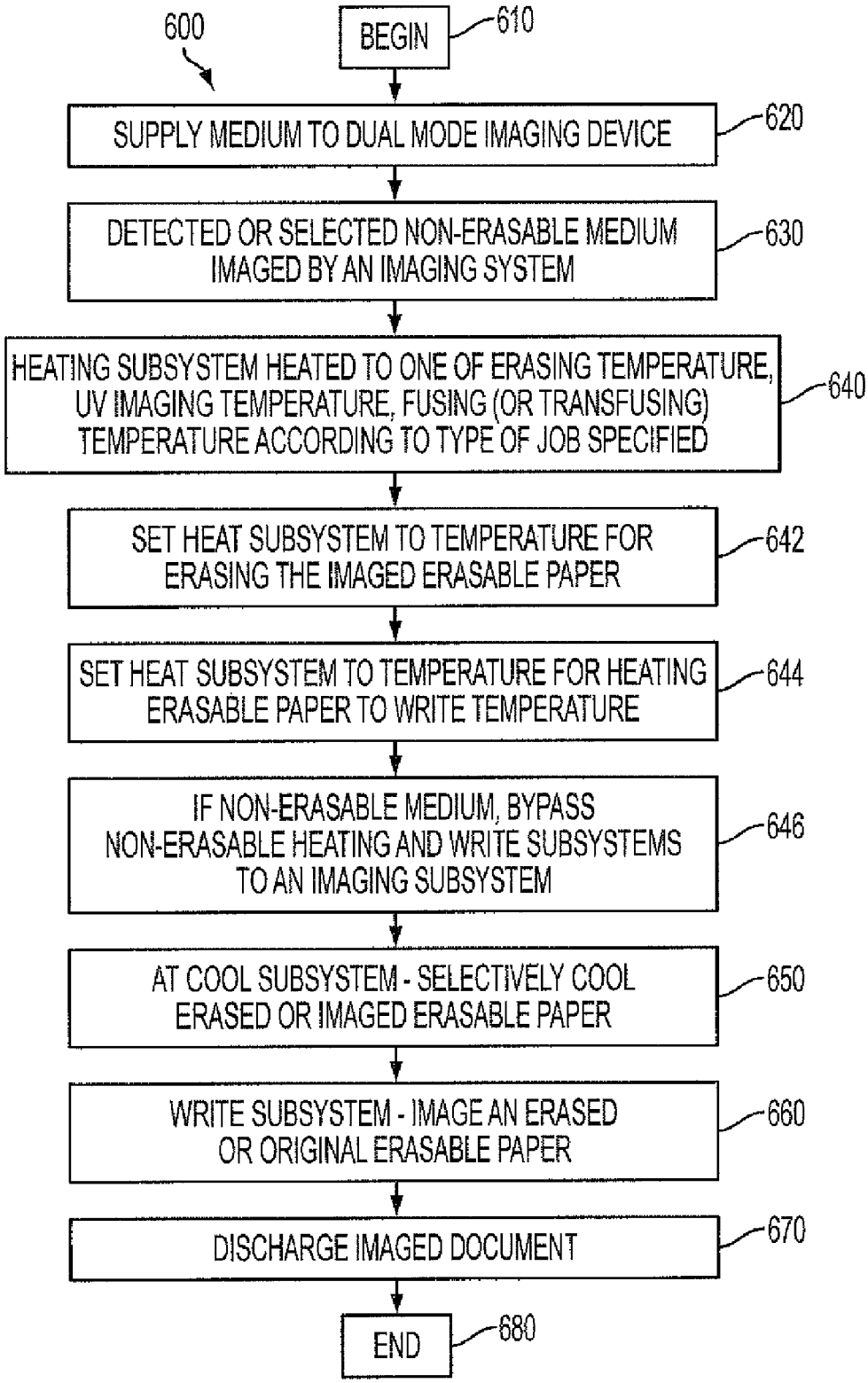
FIG. 6 depicts an exemplary method for forming images in the dual mode imaging apparatus in accordance with the present teachings.

FIG. 6 discloses a method 600 of dual mode imaging in accordance with the present teachings. It should be readily apparent to one of ordinary skill in the art that the method 600 represents a generalized schematic illustration and that other components can be added or existing components can be removed or modified.

The method can begin at 610. At 620, a medium is supplied to a dual mode imaging device. The medium can include at least one of an erasable paper and a non-erasable paper. The erasable paper can include an erased or original erasable paper or an imaged and hence erasable paper.

At 630, a detected or selected non-erasable paper can be imaged by a conventional imaging system. The conventional imaging system can include one of an ink jet device, a xerographic imaging device and a liquid ink electrophotography device. An ink jet device can further include one of an aqueous, solid, or gel type ink jet.

At 640, a heating subsystem is heated to one of an erasing temperature, an imaging temperature (such as a UV imaging temperature), and a fusing (or transfusing) temperature according to job requirements. In the presence of an imaged erasable paper, the heating subsystem, at 642, can be set to a temperature for erasing the imaged erasable paper. In the presence of an erased or original erasable paper, the heating subsystem, at 644, can be set to a temperature for heating the erasable paper to a temperature suitable for imaging in a write subsystem. In the presence of a non-erasable paper, at 646, the heating subsystem and write subsystem can be bypassed or passed through in favor of imaging at the conventional imaging subsystem. In certain embodiments, a fuser or transfuser of the conventional imaging subsystem can be used as the heat subsystem for heating erasable paper.

At 650, a cooling subsystem can selectively cool an erased paper to a temperature suitable for imaging. The cooling subsystem can further selectively cool an imaged erasable paper prior to discharge from the dual mode imaging system.

At 660, a write subsystem can image an erased or original erasable paper.

At 670, an imaged document, whether erasable paper or non-erasable paper, can be discharged to an output receptacle of the dual mode imaging system.

At 680, the method can end, but the method can return to any point and repeat.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A dual mode imaging system comprising:

an input for supplying media to the imaging system, the media comprising an imaged erasable paper and a non-erasable paper;

an imaging subsystem for imaging the non-erasable paper;

a heating subsystem for selectively heating the imaged erasable paper to an erasing temperature to change the imaged erasable paper to a non-imaged erasable paper;

wherein the heating subsystem is further configured to heat the non-imaged erasable paper to a UV imaging temperature according to a type of imaging job, wherein the erasing temperature is higher than the UV imaging temperature;

a cooling subsystem for selectively and actively cooling the non-imaged erasable paper to an imaging temperature by directing a flow of a cooling medium onto the non-imaged erasable paper; and a UV write subsystem for UV imaging erasable paper.

2. The system of claim 1, wherein said heating subsystem is configured to heat an erasable paper to a UV imaging temperature and is further configured to heat a non-erasable paper to a toner bonding temperature.

3. The system of claim 1, wherein the erasing temperature is in a range of about 80° C. to about 200° C.

4. The system of claim 3, wherein the erasing temperature is in a range of about 90° C. to about 170° C.

5. The system of claim 1, wherein the UV imaging temperature is in a range of about 55° C. to about 80° C.

6. The system of claim 5, wherein the UV imaging temperature is in a range of about 60° C. to about 70° C.

7. The system of claim 1, further comprising at least one of a user interface for configuring the dual mode imaging system and an administrator interface for configuring the dual mode imaging system.

8. The system of claim 1, further comprising a sensor for detecting a type of input media, the sensor interconnected to a control system for directing each medium to a required subsystem sequence for a selected printing mode.

9. The system of claim 1, wherein the heating subsystem comprises a fuser device.

10. The system of claim 9, wherein the fuser device selectively heats the imaged erasable paper to the erasing temperature, heats the non-imaged erasable paper to the imaging temperature, and fuses a medium imaged at a xerographic based imaging subsystem.

11. The system of claim 1, wherein the heating subsystem comprises a transfuser device.

12. The system of claim 11, wherein the transfuser device selectively heats imaged erasable paper to the erasing temperature, heats the non-imaged erasable paper to the imaging temperature, and fuses a medium imaged at one of a xerographic based imaging subsystem, a solid ink based imaging subsystem, and a liquid ink electrophotography based imaging subsystem.

13. The system of claim 1, wherein a medium heated to the erasing temperature circulates through the cooling station prior to being heated to the imaging temperature.

14. The system of claim 1, wherein the imaging subsystem comprises one of an ink jet based device, liquid ink electrophotography device, and xerography device.

15. The system of claim 1, wherein the input is configured to supply a photochromic paper as the erasable paper.

16. The system of claim 1, wherein the dual mode printing system comprises a multi-function device (MFD).

17. The dual mode imaging system of claim 1, wherein the cooling subsystem is configured to direct a flow of cold air onto the non-imaged erasable paper.

18. A method of dual mode imaging comprising:

supplying media to a dual mode imaging device, the media comprising an erasable paper and a non-erasable paper, the erasable paper comprising an imaged erasable paper;

imaging the non-erasable paper in a conventional imaging subsystem;

erasing the imaged erasable paper by heating the imaged erasable paper using a heating subsystem to an erasing temperature to form a non-imaged erasable paper;

selectively and actively cooling the non-imaged erasable paper to an imaging temperature at a cooling station by directing a flow of a cooling medium onto the non-imaged erasable paper; and UV imaging the non-imaged erasable paper at a UV write subsystem wherein the UV imaging of the non-imaged erasable paper occurs at a lower temperature than the erasing of the imaged erasable paper.

19. The method of claim 18, further comprising determining a type of input medium using a sensor interconnected to a control system for directing the medium to a required subsystem sequence for a selected printing mode.

20. The method of claim 18, further configuring the dual mode imaging system at an interface, wherein configuring comprises selecting at least one of a single mode and dual mode.

21. The method of claim 20, wherein single mode images comprise one of erasable paper and non-erasable paper.

22. The method of claim 18, wherein configuring the dual mode imaging system at an interface controls the heating subsystem according to a type of job specified.

23. The method of claim 18, wherein the heating subsystem comprises heating a medium via a fuser device.

24. The method of claim 23, wherein the conventional imaging subsystem is a toner based imaging subsystem and the fuser device selectively heats the imaged erasable paper to the erasing temperature, heats the non-imaged erasable paper to a UV imaging temperature, and fuses a medium imaged at the toner based imaging subsystem.

25. The method of claim 24, wherein the heating subsystem comprises heating a medium via a transfuser device.

26. The method of claim 25, wherein the transfuser device selectively heats the erasable medium to the erasing temperature, heats the non-imaged erasable paper to the UV imaging temperature, and fuses a medium imaged at one of a xerography based, ink jet based, and liquid ink electrophotography based imaging subsystem.

27. The method of claim 18, wherein the imaging subsystem comprises one of an ink jet device, a xerography device, and a liquid ink electrophotography device.

28. The method of claim 27, wherein the ink jet device comprises one of an aqueous ink jet device, a solid ink jet device or a gel ink jet device.

29. The method of claim 18, wherein selectively and actively cooling the non-imaged, erasable paper further comprises directing a flow of cold air onto the non-imaged erasable paper.

* * * * *